US005133152A

United States Patent [19]

Grancagnolo

[11] Patent Number: 5,133,152

[45] Date of Patent: Jul. 28, 1992

[54] HEAVY DUTY CONSTANT USE SELF CLOSING GATE

[76] Inventor: Edward J. Grancagnolo, 216 Northfield Rd., Hauppauge, N.Y. 11788

[21] Appl. No.: 813,517

[22] Filed: Dec. 26, 1991

[51] Int. Cl.[5] ..... E05D 7/06; E05F 1/04

[52] U.S. Cl. ..... 49/239; 16/312; 16/314

[58] Field of Search ..... 49/236, 237, 238, 239; 16/312, 314, 316, 315, 313

[56] References Cited

U.S. PATENT DOCUMENTS

| | | | |
|---|---|---|---|
| Re. 24,059 | 9/1955 | Pinion et al. | 49/293 X |
| 1,383,961 | 7/1921 | Melugin | 16/314 |
| 3,626,547 | 10/1969 | Werner | 16/314 |
| 4,253,275 | 3/1981 | Killough | 49/239 |
| 4,494,275 | 1/1985 | Hsi-Shan | 16/314 |
| 5,052,531 | 6/1991 | McCarty | 16/313 |

*Primary Examiner*—Philip C. Kannan
*Attorney, Agent, or Firm*—Galgano & Belkin

[57] ABSTRACT

A self closing gate comprising a pair of first and second parallel and spaced vertically extending stationary posts. The gate is mounted between the posts for rotation about the first post between positions closing the space between the posts and opening the space. A pivot assembly is mounted on the first post between one end of the gate and the first post, the pivot assembly comprising an outer rotatable housing tube and a stationary and vertically extending shaft. A stationary housing tube is mounted below and aligned with and for supporting the rotatable housing tube, the bottom annular edge of the rotatable housing tube and the top of the stationary tube being at a bias so that when the gate is opened it will rise. Gravity will close the gate when released.

5 Claims, 3 Drawing Sheets

FIG. 1
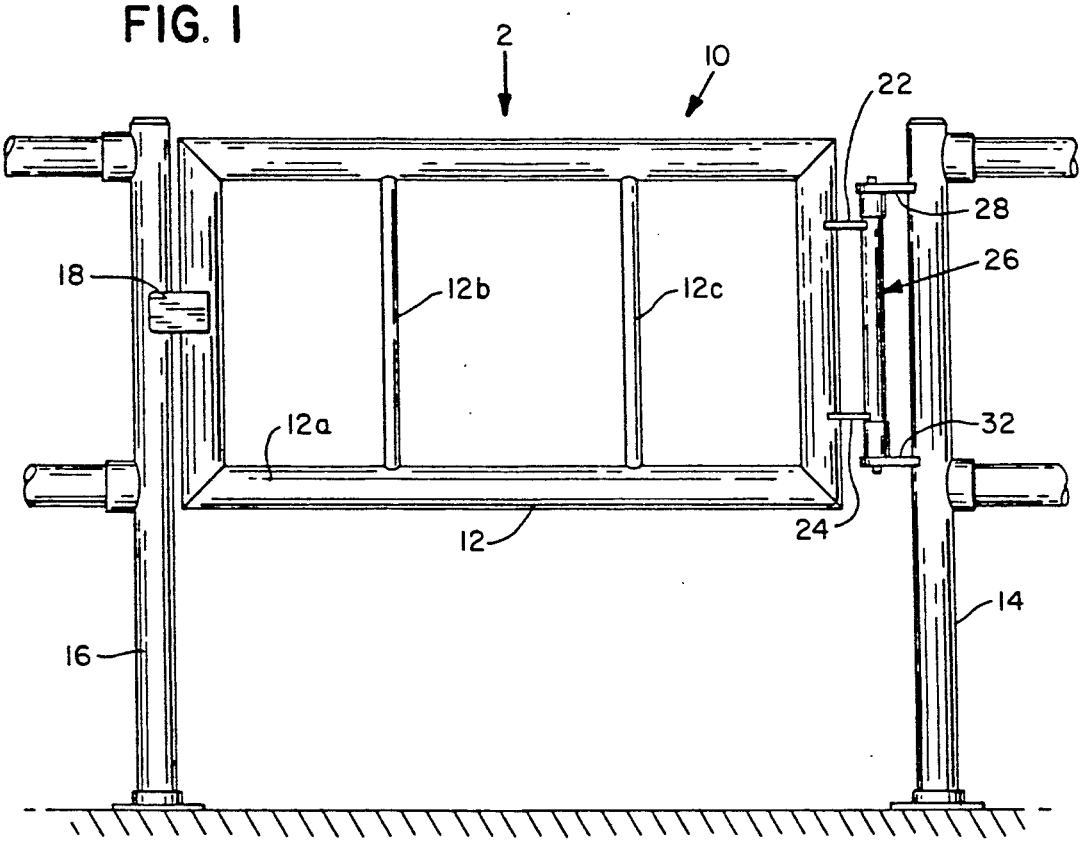
FIG. 2
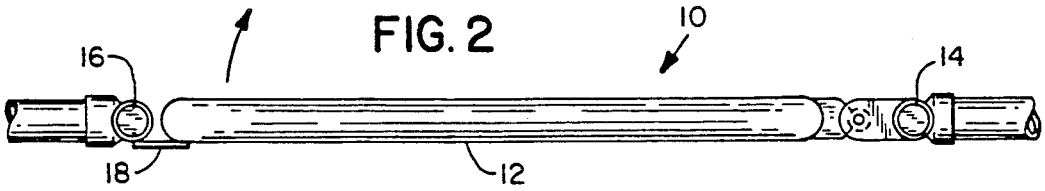
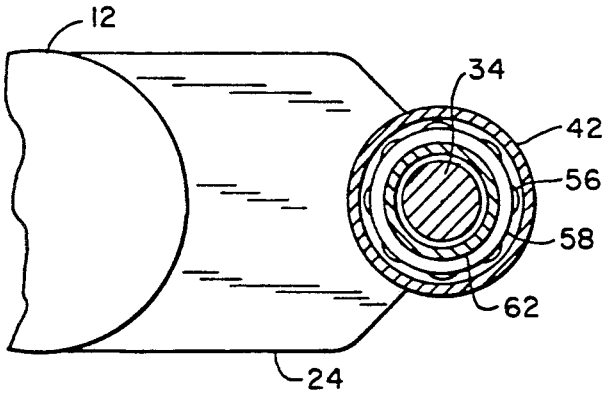
FIG. 4
FIG. 5
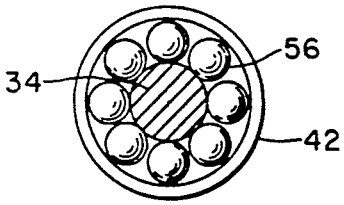

HEAVY DUTY CONSTANT USE SELF CLOSING GATE

BACKGROUND OF THE INVENTION

This invention relates a self-closing gate and more particularly to a self closing gate capable of heavy duty and constant use.

Turnstiles provide an effective means of controlling volume traffic in one direction but have a number of deficiencies. They are expensive to install and maintain, lack the ability to accomodate handicapped persons, especially those in wheel chairs, and do not allow for passage of carts or bulk materials.

As an alternative to turnstiles for use in certain situations, hinged gates are manufactured and used to control the movement of persons where handicap accessibility is desired or required and such gates also allow for the passage of carts and bulky articles. They also have the capability of permitting traffic in both directions.

A drawback of hinged gates now in use is their inability to handle volume traffic and be in constant use without requiring extensive and continuous maintenance. When hinged gates now in use are designed to be self closing a spring of some type is employed to obtain this feature. Such gates do not stand up to heavy use and must be constantly be repaired to be kept in service.

SUMMARY OF THE INVENTION

In this invention there is provided a hinged, self-closing gate of simple design and construction which is capable of handling large amounts of traffic and be in constant use and requiring little or no maintenance.

A preferred embodiment of this invention comprises a gate which is hinged on one side. The hinged side of the gate is attached to a rotatable outer tube which is supported by and encloses a stationary support rod attached at the bottom and top by a rail post. Ball bearings located near the bottom and near the top of the rotatable outer tube insures relatively friction free movement of the outer tube. The bottom of the outer tube is split at an angle below the lower ball bearings, with the bottom portion of the tube being held stationary and attached to a stationary pivot. Hence, when the gate is turned, rotation of the outer tube causes the latter to rise so that when the gate is released it will return to its closed position due to the effect of gravity. A spring may be employed at the top only to prevent the outer tube from binding or catching when the gate is fully open.

It is thus a principal object of this invention to provide a gate of simple and economic construction capable of volume traffic and constant use with little or no maintenance or repair required.

Other objects and advantages of this invention will hereinafter become obvious from the following description of the preferred embodiments.

BRIEF DESCRIPTION OF THE DRAWINGS

FIG. 1 is an elevation view of a gate which incorporates the principles of this invention.

FIG. 2 is a top view of the gate shown in FIG. 1.

FIG. 4 is a section view taken along 4—4 of FIG. 3.

FIG. 5 is a section view taken along 5—5 of FIG. 3.

DESCRIPTION OF THE PREFERRED EMBODIMENTS

Figure 3:
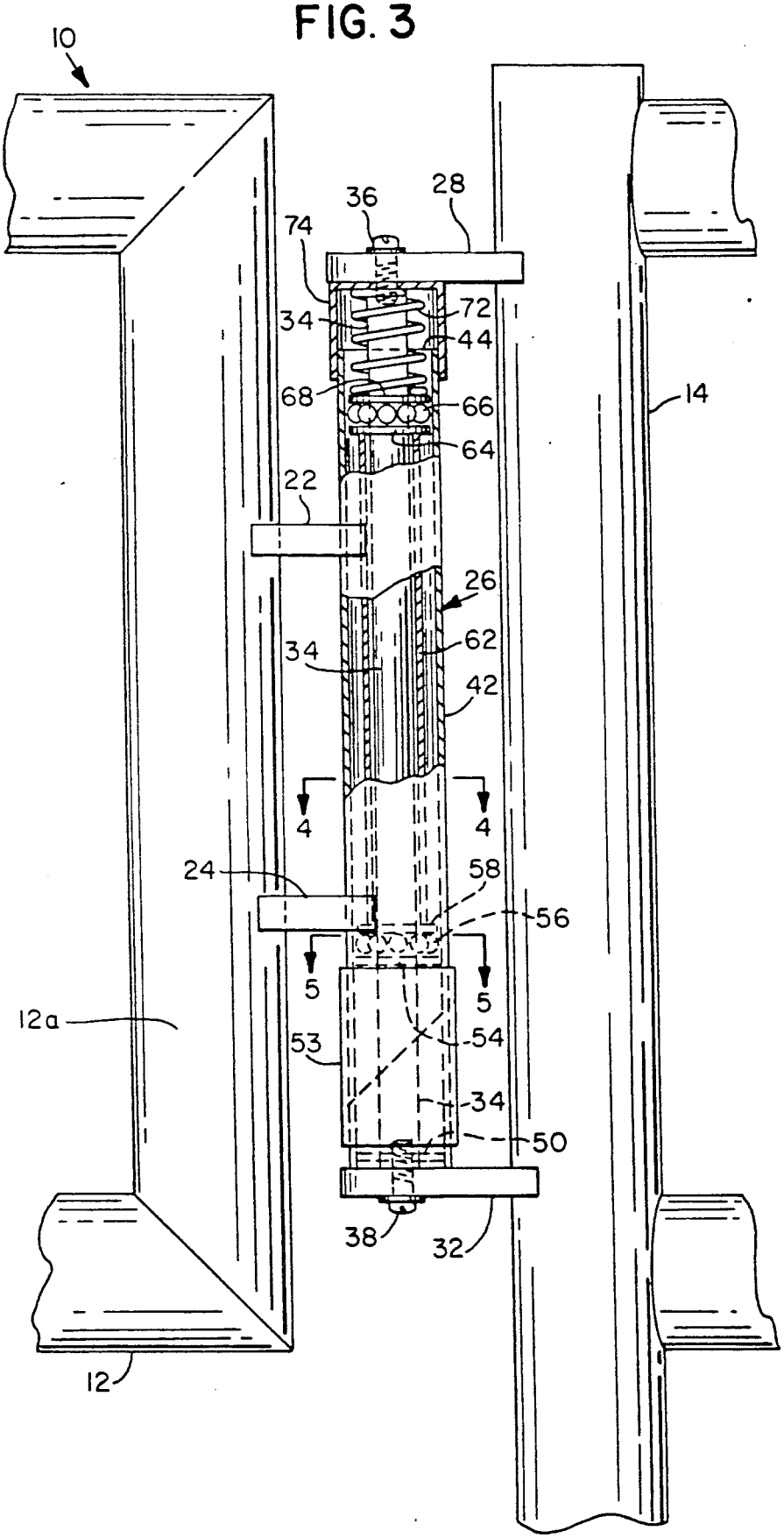
FIG. 3 is an elevation view of the hinging mechanism partially cut away to show the structural details.

Referring to FIGS. 1 and 2, gate assembly 10 comprises a gate 12 supported in a manner to be described by vertically extending rail post 14. Opposite the latter is a vertically extending rail post 16 which together with post 14 form the opening controlled by gate 12 in the manner illustrated.

Gate 12 may be of any convenient or conventional construction such as that shown in FIGS. 1 and 2 in which is shown constructed of rectangular arranged tubing 12*a* with reinforcing bars 12*b* and 12*c*.

A stop 18 attached to rail post 16 limits the direction of swing of gate 12 as shown by the arrow in FIG. 2. The stop may be attached to the other side of post 16 to provide for gate 12 to swing in the opposite direction, or if the stop is removed altogether, gate 12 may swing in either direction.

Gate 12 is pivotally attached to rail post 14 by way of a pair of pivot blocks 22 and 24 attached to the outside of pivot assembly 26 which is attached at the top and bottom to rail post 14 using a pair of stationary pivot blocks 28 and 32.

As seen particularly in FIGS. 3–7, pivot assembly 26 consists of a stationary rod 34 extending between upper and lower stationary pivot blocks 28 and 32, respectively, and attached thereto using a pair of holding nuts and bolts 36 and 38.

Mounted for rotation about and spaced from rod 34 is an outer housing tube 42 which terminates at the top at 44 and at the bottom in an annular edge 46 which is at an angle, typically about 45 degrees. Directly beneath outer housing tube 42 is a stationary tube 48 resting on bottom pivot block 32 and attached using a washer 50 welded in place. Tube 48 is identical in diameter to tube 42 with an upwardly facing annular edge 52 at the same angle as edge 46 so that tube 42 rests on 48 with edges 46 and 52 in contact with each other.

A skirt 53 attached to the outside of tube 42 adjacent the bottom thereof acts to fully enclose edges 46 and 52.

Figure 8:
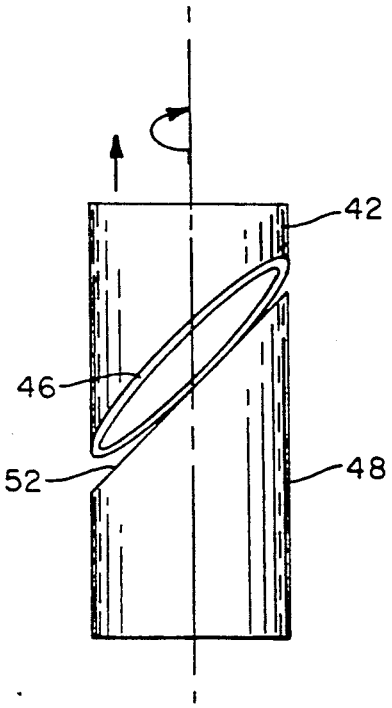
FIG. 8 is an illustrative view of the outer housing tube being rotated.

When outer housing tube 42 is caused to rotate by swinging gate 12, tube 42 will rise as a result of the bias or angle of edges 46 and 52 as seen in FIG. 8. It will be noted that the lowest point of edge 42 is in the plane formed by rail posts 14 and 16 so that the weight of gate 12 will keep the latter closed, and, as gate 12 is opened, as noted, the latter will rise.

Figure 6:
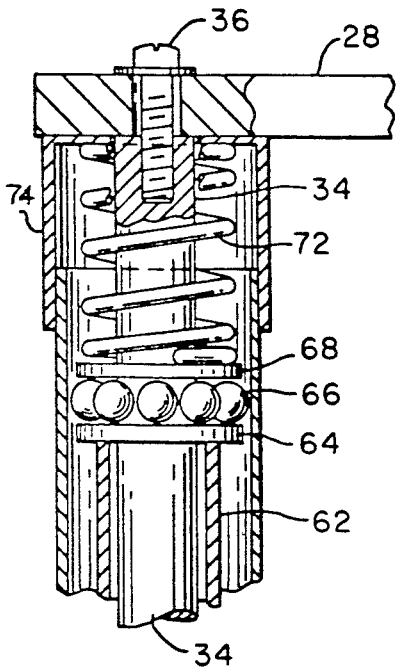
FIG. 6 is a detail of the top of the pivot assembly partially cut away.
Figure 7:
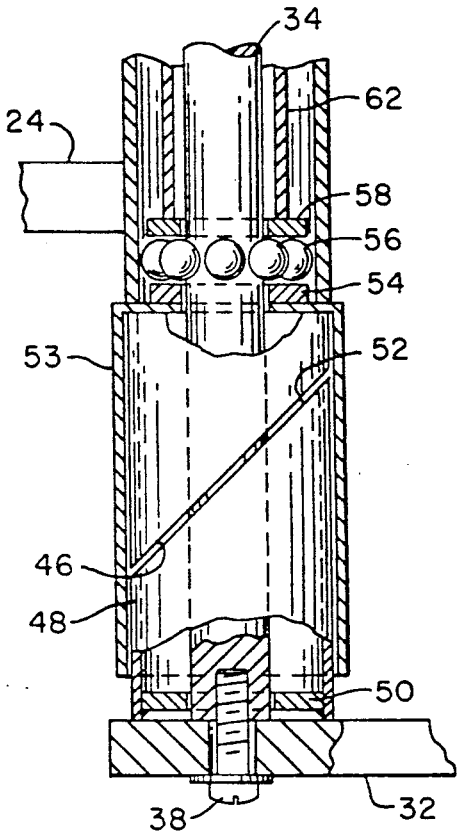
FIG. 7 is a detail of the bottom of the pivot assembly partially cut away.

As also seen in FIGS. 6 and 7, inside of outer housing tube 42 located near the bottom thereof is welded in place a washer 54 to support ball bearings 56. Resting on ball bearings 56 is a washer 58 and a spacer tube 62 at the top of which is another washer 64 which supports another set of ball bearings 66. On top of ball bearings 66 is a washer 68 on which is a compression coil spring 72. A cover cap 74 is mounted as illustrated to enclose spring 72. The top of cover cap 74 is trapped between the top of rod 34 and the underside of pivot block 28.

Ball bearings 56 and 66 permit virtually friction free movement between outer housing tube 42 and stationary rod 34 with which the bearings are in contact. Pivot blocks 22 and 24 are attached at one end each to gate 12 and at their opposite ends are attached to rotatable outer housing tube 42. Typically these attachments would be accomplished by welding.

The presence of spring 72 is only to provide a light downward bias to tube 42 to overcome any binding which might occur when gate 12 is fully open since the weight of gate 12 along with tube 42 and attached structure will ordinarily be sufficient to bring gate 12 back to its closed position after it is opened and released and to keep closed in a positive manner.

The use of ball bearings in the manner described is believed to be of particular value to insure that the mechanism is trouble free and long wearing so that little or no maintenance should be required even from continuous use of the gate.

It will also be seen that the construction of gate assembly 10 is simple and economic. Except for the welding of the pivot blocks to their respective rails and outer housing 42, and the welding of washers 50 and 54, and the attachment of nuts and bolts 36 and 38, the parts are assembled by merely placing them in the sequence described above.

Thus the self closing gate herein described is extremely inexpensive to manufacture while at the same time it is reliable, efficient, and long lasting with a minimum of maintenance and repair required.

While only a certain preferred embodiment of this invention has been described it is understood that many variations are possible without departing from the principles of this invention as defined in the claims which follow.

What is claimed is:

1. A self closing gate comprising a pair of first and second parallel and spaced vertically extending stationary posts, gate means mounted between said posts for rotation about said first post between positions closing the space between said posts and opening said space, the improvement being a pivot assembly mounted on said first post between one end of said gate means and said first post, said pivot assembly comprising an outer rotatable housing tube means having upper and lower pivot blocks for attaching said gate means to said rotatable housing tube means, a pair of upper and lower stationary pivot blocks mounted on said first post, stationary and vertically extending shaft means supported at both ends by said stationary pivot blocks, said shaft means passing through and concentric with said rotatable housing tube means, stationary housing tube means mounted on said lower stationary pivot block having the same diameter as and aligned with and for supporting said rotatable housing tube means, the bottom annular edge of said rotatable housing tube means being at a bias with the lowermost portion of said edge being in a plane formed by said first and second posts when said gate is in a closed position and facing said gate means, the upper annular edge of said stationary housing tube means being cut at a bias corresponding with the lower edge of said rotatable housing tube means so that when said gate is closed the rotatable housing tube means is in its lowermost position, the upper edge of said stationary housing tube means being in contact with the bottom annular edge of said rotatable housing tube means for supporting the latter, and upper and lower ball bearing means located inside said rotatable outer housing tube means between said outer housing tube means and said stationary shaft means to permit virtually friction free rotation of said gate means, said gate means rising as said gate means is opened as a result of said rotatable outer housing tube means moving up the upper edge of said stationary housing tube means as said rotatable outer housing tube means is turned by said gate means, the weight of said gate means causing said gate means to be closed due to the effect of gravity.

2. The self closing gate of claim 1 wherein the inside of said rotatable outer housing means is provided above the bottom annular edge with an abutment to support the lower ball bearings means, and spacer tube means resting on said lower ball bearings means to support the upper ball bearings means.

3. The self closing gate of claim 2 having coil spring means within said rotatable outer housing means between the upper ball bearings means and the upper stationary pivot block to assert a downward bias on said gate means to prevent binding of said gate means in the open position.

4. The self closing gate of claim 3 having a cover cap mounted on said upper stationary pivot block to enclose said coil spring.

5. The self closing gate of claim 4 having a skirt mounted on the rotatable outer housing tube means to enclose the biased edges of said housing tube means.

* * * * *